US005378165A

United States Patent [19]

Comerci et al.

[11] Patent Number: 5,378,165

[45] Date of Patent: Jan. 3, 1995

[54] PLUG DETECTION ELECTRICAL RECEPTACLE

[75] Inventors: Joseph D. Comerci, Elmhurst; Mark M. Data, Bolingbrook; Robert DeRoss, Naperville, all of Ill.

[73] Assignee: Molex Incorporated, Lisle, Ill.

[21] Appl. No.: 151,708

[22] Filed: Nov. 12, 1993

[51] Int. Cl.[6] ..... H01R 29/00

[52] U.S. Cl. ..... 439/188; 439/489; 200/51.09

[58] Field of Search ..... 200/51 R, 51.09-51.11; 439/188, 489, 490, 512, 514, 515

[56] References Cited

U.S. PATENT DOCUMENTS

| | | | |
|---|---|---|---|
| 3,701,074 | 10/1972 | Oster . | |
| 4,389,551 | 6/1983 | Deibele et al. | 200/51 R |
| 4,426,558 | 1/1984 | Tanaka et al. | 200/51.09 |
| 4,490,587 | 12/1984 | Miller et al. | 200/5 A |
| 4,540,865 | 9/1985 | Calder | 200/340 |
| 4,623,209 | 11/1986 | Mangone . | |
| 4,927,373 | 5/1990 | Dickie | 439/188 |
| 5,006,675 | 4/1991 | Sakaguchi | 200/51.09 |
| 5,044,969 | 9/1991 | Richier | 439/188 |
| 5,052,484 | 10/1991 | Gesta | 439/188 X |
| 5,092,785 | 3/1992 | Chen | 439/188 |
| 5,186,639 | 2/1993 | Comcerci et al. | 439/188 |
| 5,248,259 | 9/1993 | Naito et al. | 439/188 X |

*Primary Examiner*—Khiem Nguyen

*Attorney, Agent, or Firm*—Stephen Z. Weiss

[57] ABSTRACT

A plug detection electrical receptacle includes a dielectric housing having at least one passage with an open mating end for receiving a male terminal of a complementary mating electrical plug and an opposite end communicating with a switch on a substrate. A female terminal is disposed in the passage for engagement by the male terminal. A detect switch is located in proximity to the passage for actuation by the male terminal when the male terminal is inserted into the passage in engagement with the female terminal. The detect switch includes an actuator at the opposite end of the passage, the actuator including a male terminal engaging portion and a switch engaging portion. A first flexible skirt extends from the actuator about the periphery thereof into sealing engagement with the substrate about the switch thereon. The flexible skirt supports the actuator with the switch engaging portion out of engagement with the switch on the substrate. The skirt flexes in response to engagement of the actuator by the male terminal to move the switch engaging portion into engagement with the switch. A second flexible skirt depends from the actuator and mounts the switch engaging portion thereon. The second flexible skirt flexes to allow for overtravel of the actuator after the switch engaging portion has engaged the switch on the substrate.

9 Claims, 3 Drawing Sheets

24
22b
24
22a
26
26
22a
60
24
20
28
29
14
62
22a
22b
24
29
22a
28
34
30
32
38
40
14
18
16
16
10
12

PLUG DETECTION ELECTRICAL RECEPTACLE

FIELD OF THE INVENTION

This invention generally relates to the art of electrical connectors and, particularly, to an electrical receptacle which has an internal switch means to detect the presence of a properly inserted plug.

BACKGROUND OF THE INVENTION

Various electrical connectors or receptacles are available in which an internal switch is incorporated in the connector to detect the presence of a properly inserted plug connector. Usually, the receptacle is normally "dead" (i.e., it does not receive current) unless the detection switch is actuated. Such systems might be used as a simple safety measure. For instance, the detection switch might be used to detect the presence of a ground terminal of a three-pronged plug. If a two-pronged plug is inserted into the receptacle, the switch will not be actuated and no current will be supplied to the receptacle unless a proper three-pronged plug is inserted into the receptacle, whereupon the ground terminal actuates the detection switch.

In certain "smart" power receptacles, it is desirable not to supply power to the receptacle unless a power plug is inserted into the receptacle. The detection switch might be actuated by any one of the prongs or blades of the power receptacle, at which point the detection switch is actuated to tell a system controller to send power to the receptacle.

Another example might be where a system has battery power backup. If the battery is constantly in an "on" mode, such as when receiving full line power, the battery would be rapidly drained, Consequently, the detection switch might be used to disconnect the battery power in the presence of a plug inserted into the receptacle.

In some detection switches, the contacts of the switches are deflected indirectly by a terminal prong or blade through a separator made of an insulating material. This is particularly true in a power receptacle since the detection switch usually is a low voltage switch. The insulator provides electrical isolation between the low voltage circuit and the higher voltage circuit of the power receptacle.

One of the problems with electrical connectors or receptacles which embody detection switches is that the receptacles are unduly complicated or require excessive components. If not complicated, the receptacles are not cost effective because of assembly procedures involved in assembling the detection switch within an otherwise simple electrical connector or receptacle. An approach to solving these problems is shown in U.S. Pat. No. 5,186,639, dated Feb. 16, 1993 and assigned to the assignee of this invention. That patent discloses a very simple plug detection electrical receptacle which is very easy to assemble, with all of the components being assembled into a housing in a single direction. In addition, that patent shows a detect contact which is engageable by a resilient actuator contact, with the resilient actuator contact having an insulating separator non-removably fixed thereto. The insulating separator is disposed in a path of insertion of a male terminal for engagement by the male terminal to bias the resilient actuator contact into engagement with the detect contact to close a circuit therethrough.

The present invention is directed to providing a further improved electrical connector with a plug detection switch which is further simplified and easy to manufacture and, in addition, provides a sealing function about switch contact means on a printed circuit board, panel or other substrate.

SUMMARY OF THE INVENTION

An object, therefore, of the invention is to provide a new and improved plug detection electrical connector or receptacle of the character described.

In the exemplary embodiment of the invention, an electrical receptacle includes a dielectric housing having at least one passage with an open mating end for receiving a male terminal of a complementary mating electrical plug and an opposite end communicating with a switch means on a substrate. A female terminal is disposed in the passage for engagement by the male terminal. A detect switch is located in proximity to the passage for actuation by the male terminal when the male terminal is inserted into the passage in engagement with the female terminal.

The invention contemplates an improvement in the detect switch wherein an actuator is provided at the opposite end of the passage in the dielectric housing, with the actuator including a male terminal engaging portion and a switch means engaging portion. A flexible skirt is located about the actuator and extends therefrom into sealing engagement with the substrate. The flexible skirt supports the actuator with the switch means engaging portion out of engagement with the switch means on the substrate. The skirt flexes in response to engagement by the male terminal to move the switch means engaging portion into engagement with the switch means.

The invention further contemplates that the switch means engaging portion be mounted on the actuator by resilient means. The resilient means allows for overtravel of the actuator after the switch means engaging portion has engaged the switch means on the substrate.

In the preferred embodiment of the invention, the resilient means for mounting the switch means engaging portion on the actuator is provided by a second flexible skirt depending from the actuator. The flexible skirt and the second flexible skirt comprise integrally molded portions of the actuator. The switch means engaging portion is a conductive contact pad, and the male terminal engaging portion is a separate wear resistant member mounted on the actuator. The actuator is generally hollow, with an open end communicating with the second flexible skirt, and the wear resistant member is mounted in the open end of the actuator.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
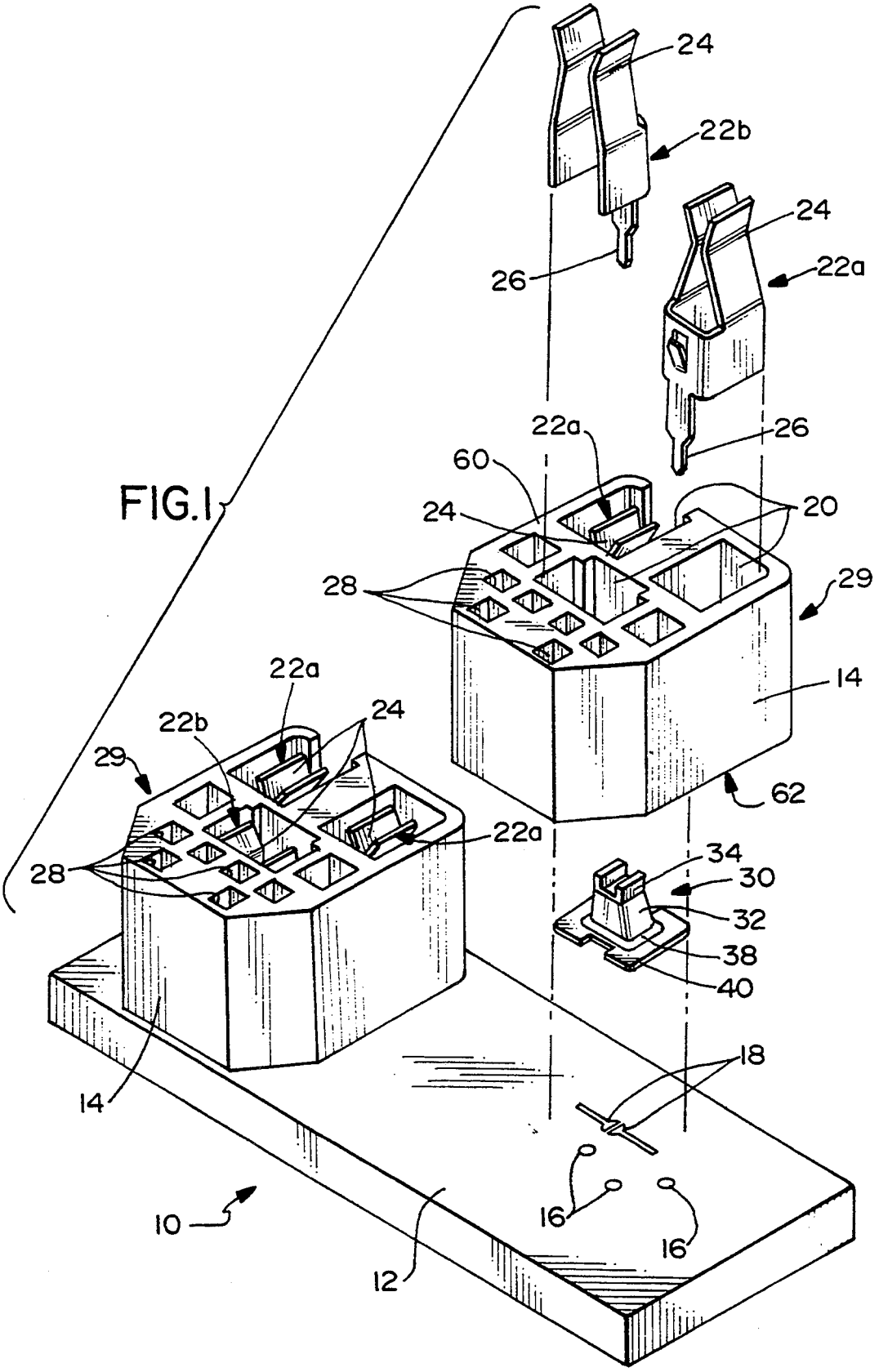
FIG. 1 is an exploded perspective view of an electrical receptacle assembly embodying the concepts of the invention.

Referring to the drawings in greater detail, and first to FIG. 1, the invention is embodied in an electrical receptacle assembly, generally designated 10, which includes a substrate 12 and a pair of upstanding housings 14. The substrate may be a circuit board having holes 16 for receiving solder tails of terminals mounted within housings 14. According to the invention, the circuit board includes a switch means in the form of a pair of spaced switch circuit traces 18 on the board.

Each housing 14 is substantially identical and includes passages 20 for receiving female power terminals, generally designated 22*a* and a female ground terminal 22*b*. The power terminals are substantially similar to the ground terminal, except for their orientation, as seen by the isolated terminals 22*a* and 22*b* above the right-hand housing 14 shown in FIG. 1. Each terminal includes a receptacle end 24 for receiving a male terminal prong or blade of a complementary mating electrical plug (not shown). The terminals also include tail portions 26 which project out of the bottom of housings 14 for insertion into holes 16 in circuit board 12. The tails may form solder tails for soldering to circuit traces on the board or in the holes. As seen in FIG. 1, female terminals 22*a* are power terminals and female terminal 22*b* is a ground terminal.

Each housing 14 also has a plurality of passages 28 for receiving a plurality of female data terminals which are not shown in the drawings. Each data terminal will include a receptacle portion for receiving a data terminal pin from the complementary mating electrical plug, along with an appropriate solder tail portion for projecting below the respective housing 14 into appropriate holes (not shown) in the circuit board for electrical connection to data circuit traces on the board.

From the foregoing, it can be understood that each housing 14 and its respective power and data terminals form an electrical receptacle, generally designated 29, for mating with a complementary electrical plug. The two receptacles are mounted on circuit board 12 to form the composite electrical receptacle assembly 10. Therefore, from this point on, the following description generally will be applicable to only one of the receptacles and its housing 14 and power and ground terminals 22*a* and 22*b*, respectively.

Generally, the invention contemplates providing a detect switch, generally designated 30, located in each housing 14 in proximity to the passage 20 for receiving the power terminal 22*a* for actuation by a neutral male terminal of the complementary mating connector. However, it should be understood that the invention is equally applicable for use with any type of electrical connector and any of its respective terminals.

Figure 2:
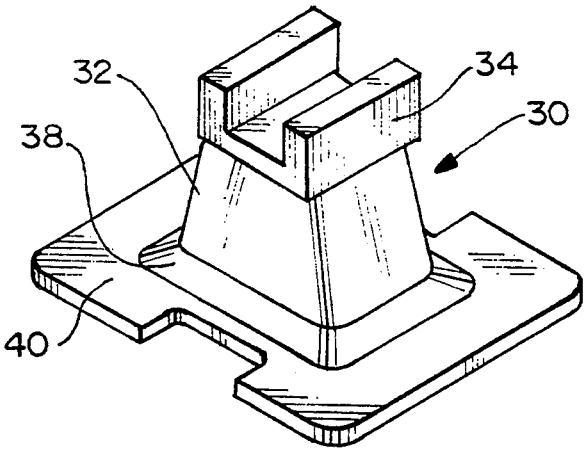
FIG. 2 is a perspective view of the detect switch of the invention.
Figure 3:
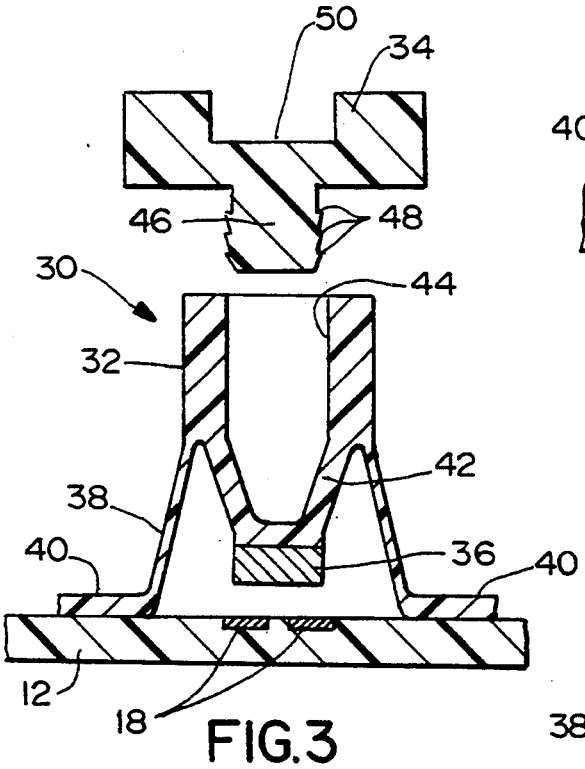
FIG. 3 is a vertical section through the detect switch, with the switch mounted to a circuit board, and with the male terminal engaging cap removed to facilitate the illustration.

Referring to FIGS. 2 and 3 in conjunction with FIG. 1, detect switch 30 includes an actuator 32 which has a male terminal engaging portion 34 and a switch means engaging portion 36. An outer flexible skirt 38 is located about actuator 32 and extends downwardly and outwardly therefrom to a flange 40 which establishes a sealing engagement with circuit board 12. A resilient means in the form of a second, inner flexible skirt 42 mounts the switch means engaging portion 36 to actuator 32.

More particularly, actuator 32 is generally hollow to define an opening 44 into which a plug portion 46 of male terminal engaging portion 34 is insertable. The plug portion has radially outwardly projecting circumferential ridges 48 for resisting removal of the male terminal engaging portion 34. Opening 44 also provides a core-out hole for facilitating molding of second flexible skirt 42.

In essence, male terminal engaging portion 34 forms a cap having a recessed surface 50 for engagement by the male terminal. The cap is fabricated of relatively hard plastic material which is wear resistant to accommodate repeated insertions and engagements with the male terminal.

Figure 4:
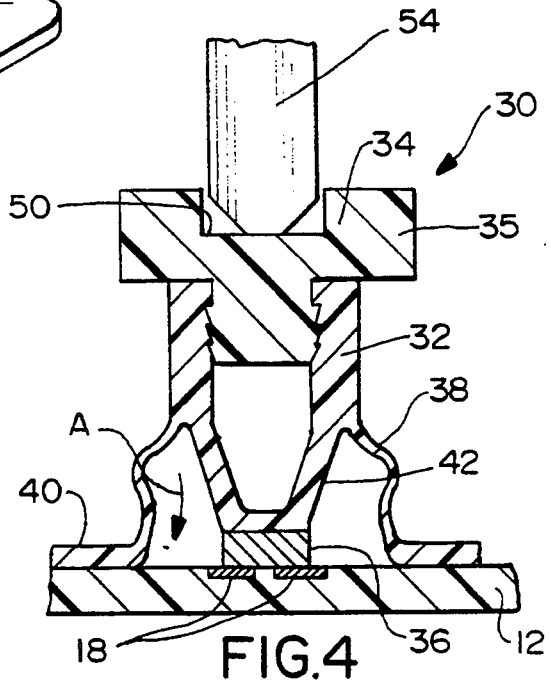
FIG. 4 is a view similar to that of FIG. 3, with the male terminal engaging cap mounted to the detect switch, and with a male terminal flexing the switch to close a circuit with the switch means on the circuit board.

Switch means engaging portion 36 is provided in the form of a conductive contact pad which is sufficiently large to engage both the spaced switch circuit traces 18 on circuit board 12, as seen in FIG. 3. Therefore, as will be described in relation to FIGS. 4 and 5, actuation of detect switch 30 effects the closing of a circuit through circuit traces 18 by means of conductive contact pad 36.

Outer flexible skirt 38 is continuous about the periphery of actuator 32 and joins the actuator to flange 40 and thereby define a sealed interior cavity 52 about circuit traces 18 and contact pad 36. With flange 40 sealed to circuit board 12, the circuit traces and the contact pad are environmentally protected within cavity 52.

Lastly, the resilient means provided by second, inner flexible skirt 42 allows for overtravel of actuator 32 after the switch has been closed by flexing of the outer flexible skirt 38. More particularly, referring to FIG. 4 in conjunction with FIG. 3, it can be seen that a male terminal 54 of the complementary mating electrical plug (not shown) has been inserted into engagement with the male terminal engaging portion of the detect switch defined by wear resistant cap 34. The detect switch has been depressed by flexing of outer flexible skirt 38 whereby conductive contact pad 36 has been moved downwardly in the direction of arrow "A" into engagement with the switch means on circuit board 12 defined by switch circuit traces 18. An appropriate circuit through circuit traces 18 thereby can be used to give an appropriate electrical indication that male terminal 54 and its entire mating electrical plug has been mated with electrical receptacle assembly 10.

Figure 5:
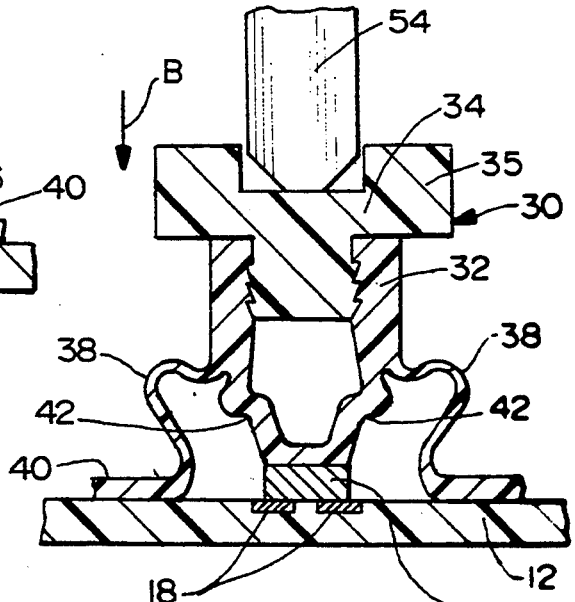
FIG. 5 is a view similar to that of FIGS. 3 and 4, with the detect switch further flexed to accommodate overtravel of the male terminal.

Now, referring to FIG. 5 in conjunction with FIGS. 3 and 4, the invention also contemplates the use of resilient means in the form of the second or inner flexible skirt 42 to allow for overtravel of actuator 32 after conductive contact pad 36 has engaged switch circuit traces 18 as described above in relation to FIG. 4. In essence, due to various tolerance parameters, male terminal 54 may tend to depress detect switch 30 further in the direction of arrow "B" (FIG. 5) after conductive contact pad 36 has initially engaged circuit traces 18. If this happens, outer flexible skirt 38 simply flexes further as shown in FIG. 5, and inner flexible skirt 42 also flexes to accommodate the overtravel condition. FIG. 5 also shows rather dramatically how all of these functions are facilitated by a one-piece component including actuator 32, outer flexible skirt 38 and inner flexible skirt 42, all of which can be unitarily molded of plastic material.

It can be seen that outer flexible skirt 38 is thinner than inner flexible skirt 42. Therefore, very low insertion forces are involved. However, the thicker inner flexible skirt 42 not only allows for overtravel of the actuator, but the thicker skirt effects a positive interconnection between conductive contact pad 36 and switch circuit traces 18 in response to the overtravel of the male terminal.

Figure 6:
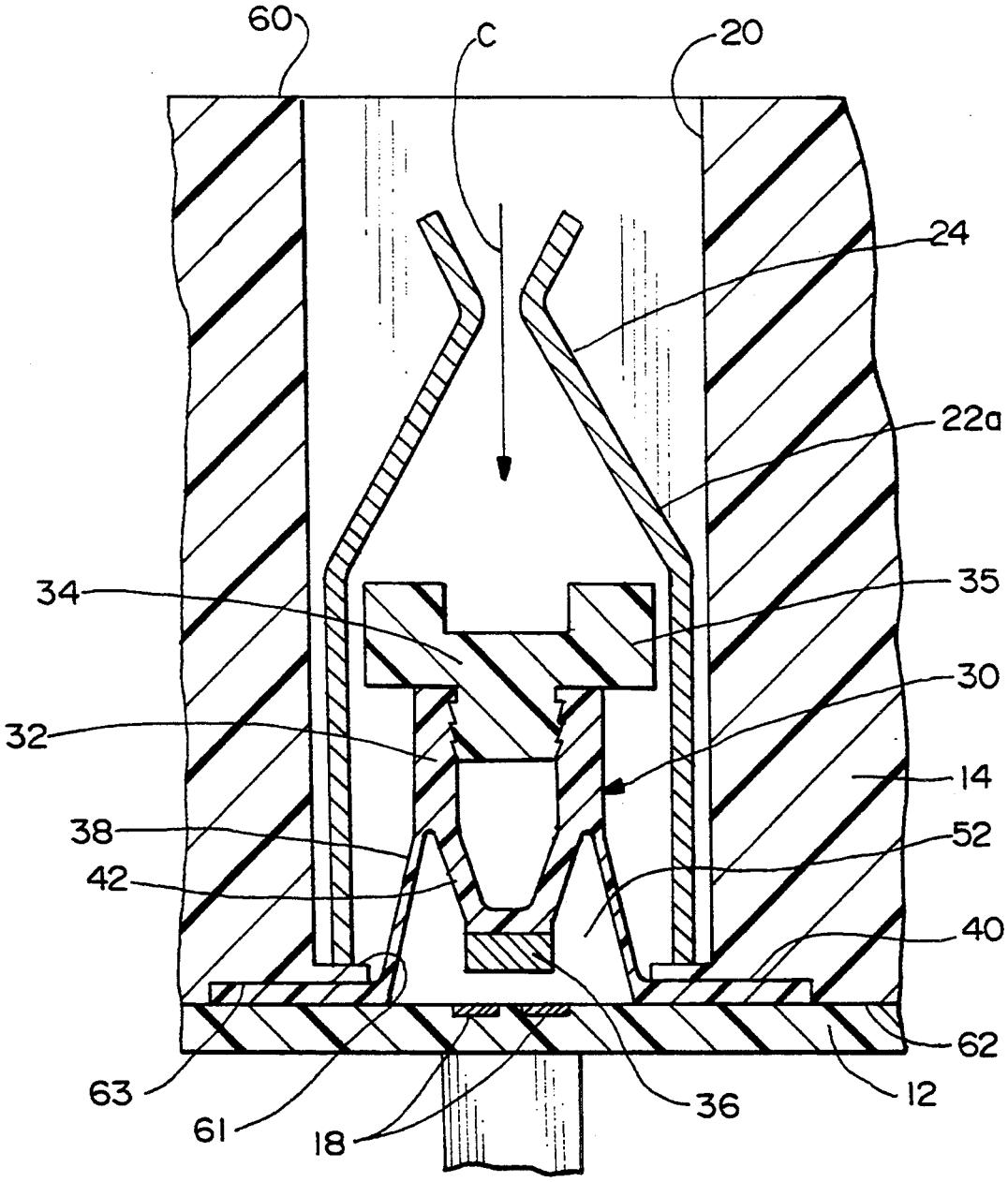
FIG. 6 is a fragmented vertical section through the receptacle assembly, illustrating the location of the detect switch.

Lastly, FIG. 6 shows the location of detect switch 30 within passage 20 for power terminal 22*a* connected to the neutral line. The passage has an open mating end 60 for receiving male terminal 54 (FIGS. 4 and 5) and an opposite end 62 communicating with the switch means defined by circuit traces 18 on circuit board 12. It can be seen that the opposite end of the passage has a shoulder 61 for clamping flange 40 between housing 14 and the circuit board and effecting a seal between the flange and the board. Counter bore 63 locates the flange to the bottom portion of the housing 14 under shoulder 61. The upper portion of shoulder 61 provides a surface upon which the bottom of terminal 22*a* can rest. Therefore the flange 40 is protected from any damage caused by edges on the bottom wall of terminal 22*a*. Actuator 32 and the male terminal engaging cap 34 of the detect switch are in alignment with receptacle end 24 of power terminal 22*a* connected to the neutral line so that the male terminal automatically engages detect switch 30 when the male terminal is inserted into receptacle 24 in the direction of arrow "C".

Wings 35 on terminal engaging portion 34 will contact the inner surface of vertical portion of neutral power terminal 22*a*. If the mating male terminal is not inserted squarely into the terminal receiving passage 20. The relationship between the wings 35 and the inner surface of power terminal 22*a* will maintain actuator 32 in alignment with the terminal 22*a*.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a plug detection electrical receptacle which includes:

a dielectric housing having at least one passage with an open mating end for receiving a male terminal of a complementary mating electrical plug and an opposite end communicating with a switch means on a printed circuit board, a female terminal disposed in the passage for engagement by the male terminal, and a detect switch located in proximity to the passage for actuation by the male terminal when the male terminal is inserted into the passage and engages the female terminal, wherein the improvement in said detect switch comprises:

an actuator at said opposite end of the passage in the dielectric housing and including a male terminal engaging portion and a switch means engaging portion, said actuator being mounted for reciprocal movement on said printed circuit board over said switch means between a normal position wherein the switch engaging portion is spaced from said switch means and a detect position wherein the switch engaging portion engages the switch means in response to the engagement of the actuator by the male terminal;

a flexible skirt about the actuator and extending therefrom into sealing engagement with the printed circuit board about the switch means, the flexible skirt supporting the actuator with the switch means engaging portion out of engagement with the switch means on the printed circuit board, and whereby the skirt flexes in response to engagement of the actuator by the male terminal to move the switch means engaging portion into engagement with the switch means, and resilient means comprising a second flexible skirt depending from the actuator mounting the switch means engaging portion on the actuator to allow for overtravel of the actuator after the switch means engaging portion has engaged the switch means on the printed circuit board.

2. In a plug detection electrical receptacle as set forth in claim 1, wherein said flexible skirt and said second flexible skirt comprise integrally molded portions of the actuator.

3. In a plug detection electrical receptacle as set forth in claim 2, wherein said switch means engaging portion comprises a conductive contact pad.

4. In a plug detection electrical receptacle as set forth in claim 2, wherein said male terminal engaging portion comprises a separate wear resistant member mounted on the actuator.

5. In a plug detection electrical receptacle as set forth in claim 4, wherein said actuator is generally hollow with an open end communicating with the second flexible skirt, said wear resistant member being mounted in the open end of the actuator.

6. In a plug detection electrical receptacle which includes:

a dielectric housing having at least one passage with an open mating end for receiving a male terminal of a complementary mating electrical plug and an opposite end communicating with a switch means on a printed circuit board, a female terminal disposed in the passage for engagement by the male terminal, and a detect switch located in proximity to the passage for actuation by the male terminal when the male terminal is inserted into the passage and engages the female terminal, wherein the improvement in said detect switch comprises:

an actuator at said opposite end of the passage in the dielectric housing and including a male terminal engaging portion and a switch means engaging portion, said actuator being mounted for reciprocal movement on said printed circuit board over said switch means between a normal position wherein the switch engaging portion is spaced from said switch means and a detect position wherein the switch engaging portion engages the switch means in response to the engagement of the actuator by the male terminal;

a flexible skirt about the actuator and extending therefrom into sealing engagement with the printed circuit board about the switch means, the flexible skirt supporting the actuator with the switch means engaging portion out of engagement with the switch means on the printed circuit board, and whereby the skirt flexes in response to engagement of the actuator by the male terminal to move the switch means engaging portion into engagement with the switch means, and resilient means integrally molded with the actuator mounting the switch means engaging portion on the actuator to allow for overtravel of the actuator after the switch means engaging portion has engaged the switch means on the printed circuit board.

7. In a plug detection electrical receptacle as set forth in claim 6, wherein said switch means engaging portion comprises a conductive contact pad.

8. In a plug detection electrical receptacle as set forth in claim 6, wherein said male terminal engaging portion comprises a separate wear resistant member mounted on the actuator.

9. In a plug detection electrical receptacle as set forth in claim 6, including a flange about a bottom of said flexible skirt for sealing the skirt with the substrate.

* * * * *